US007117898B1

(12) United States Patent
Irmer et al.

(10) Patent No.: US 7,117,898 B1
(45) Date of Patent: Oct. 10, 2006

(54) GUIDE RODS FOR A JACQUARD LOOM

(75) Inventors: Norbert Irmer, Villingen-Schwenninger (DE); Peter Wahl, Tuttlingen (DE)

(73) Assignee: Michel Van de Wiele NV Carpet and Velvet Machinery, Marke (BE)

( * ) Notice: Subject to any disclaimer, the term of this patent is extended or adjusted under 35 U.S.C. 154(b) by 0 days.

(21) Appl. No.: 09/454,458

(22) Filed: Dec. 3, 1999
(Under 37 CFR 1.47)

(30) Foreign Application Priority Data

Dec. 3, 1998 (DE) ..... 198 55 709

(51) Int. Cl.
*D03C 3/00* (2006.01)

(52) U.S. Cl. ..... 139/59; 139/60; 139/61; 139/62; 139/63; 139/64; 139/65

(58) Field of Classification Search ..... 139/59–65
See application file for complete search history.

(56) References Cited

U.S. PATENT DOCUMENTS 3,529,635 A * 9/1970 Horak ..... 139/59
3,828,826 A * 8/1974 Hurzeler et al. ..... 139/59
4,440,196 A * 4/1984 Arvai ..... 139/59
4,936,357 A * 6/1990 Keim et al. ..... 139/455
5,095,952 A * 3/1992 Cheng ..... 139/65
5,133,389 A * 7/1992 Griffith ..... 139/455
5,176,186 A * 1/1993 Bousfield et al. ..... 139/455
5,275,211 A * 1/1994 Roth ..... 139/455
5,309,952 A * 5/1994 Speich ..... 139/455
5,363,884 A * 11/1994 Migliorini et al. ..... 139/455
5,373,871 A * 12/1994 Speich ..... 139/455
5,511,588 A * 4/1996 Jaksic ..... 139/455
6,279,618 B1 * 8/2001 Speich et al. ..... 139/59
6,933,822 B1 * 8/2005 Haugs et al. ..... 336/100

FOREIGN PATENT DOCUMENTS

DE G 9112552.9 9/1992
EP 91810833.5 10/1991
SK 277761 12/1985

* cited by examiner

*Primary Examiner*—John J. Calvert
*Assistant Examiner*—Robert Muromoto
(74) *Attorney, Agent, or Firm*—Scott E. Kamholz; Foley Hoag LLP

(57) ABSTRACT

A guide rod assembly for a Jacquard loom is described which is narrower (10 mm or less), instead of 13 mm of conventional guide rods. This reduction in width is attained reducing the overall height of the magnet system integrated in the guide rod. The magnet system has a support member in the form of an iron core with an elongated or oval cross-section, with an excitation coil wound around the iron core. Pole strips are in contact with both front faces of the iron core. The respective top surfaces of the pole strips are spaced apart by less than 13 mm.

16 Claims, 4 Drawing Sheets

GUIDE RODS FOR A JACQUARD LOOM

FIELD OF THE INVENTION

The invention relates to a guide rod for a Jacquard loom, in particular a guide rod with an electromagnet system integrated in the guide rod.

BACKGROUND OF THE INVENTION

Such guide rods, also called selectors, are employed in large numbers in Jacquard looms. The guide rods are arranged side-by-side and stacked on top of each other, as described, for example, in G 9112552.9, EP 0494044 A1 and SK 277761.

Jacquard looms are shed-forming devices for weaving woven fabrics having large patterns. The Jacquard loom raises and lowers each warp end individually, so that woven items with a practically unlimited variety of patterns can be produced.

Conventional Jacquard looms use electronic modules with electromagnets to controllably raise and lower the individual warp threads. Blades are provided to raise and lower so-called lamellae or collar boards disposed on the guide rods. Hooks are suspended from the collar boards. Harness cords are suspended from the free ends of the hooks. These harness cords in turn are coupled to the individual warp ends. When the hook is raised, the warp end which is suspended from the hook, is also raised. A warp end can only be raised, if a collar board is maintained in its upper position. To provide a better understanding of the operation of the Jacquard looms, reference is made to the aforementioned documents.

In conventional Jacquard looms, a large number of guide rods having integrated magnet systems for attracting the Jacquard lamellae are arranged on a computer controlled PC board. Exemplary Jacquard looms may have, for example, 22 of such guide rods arranged side-by-side. The lamellae are also arranged consecutively, so that a Jacquard loom may include several hundred such guide rods.

The maximum packing density is limited by the overall height of the guide rods, since a magnet system is incorporated in each of the guide rods. The magnet system should be large enough to produce a sufficiently strong magnetic force so as to reliably attract the Jacquard lamellae when current flows through the magnet coils.

In conventional guide rods of Jacquard looms, each guide rod includes two adjacent excitation coils, which are connected in series, to attract the lamellae made of sheet metal through a magnetic force (see, for example, SK 277761 and FIGS. 4 and 5 of EP 0494044 A1). Each of the two excitation coils is disposed on an iron core having a circular cross section. A complete magnet system is formed by covering the front faces of the two excitation coils with pole strips made of sheet metal, hereafter referred to as pole strips. The conventional magnet system has to have sufficient height to produce a sufficiently strong magnetic force to attract the Jacquard lamellae, as well as a sufficiently large holding force, when current flows through the excitation coils. An exemplary pair of excitation coils may have, for example, 1420 turns and produce a holding force of 0.42 N at a DC current of approximately of 115 mA. The overall height of the magnet system, i.e., the length of the excitation coils and the iron cores, respectively, in the axial direction of the exemplary pair of excitation coils is approximately 13 mm. This height can therefore limit the maximum attainable packing density of the guide rods.

It is therefore desirable to provide magnets with a smaller overall height for conventional guide rods of a Jacquard loom to increase the packing density.

SUMMARY OF THE INVENTION

According to one aspect of the present invention, a coil arrangement is wound on a support member and covered by pole strips made of sheet metal. The support member may be made of iron and have an at least approximately oval outer surface. An excitation coil is placed around the circumferential surface of the support member. The pole strips have top surfaces which contact opposing outer surfaces of the support member, with a spacing between the top surfaces of the pole strips being less than approximately 13 mm.

According the another aspect of the invention, the support member for the excitation coil may be in the form of a cuboid or have an approximately oval shape with an elongated cross section, with a single excitation coil wound around the support member. Both the support member and the excitation coil have an overall height in the axial direction which is small enough so that the spacing between the opposing top surfaces of the pole strips which are arranged on opposing outer surfaces of the support member, can be less than 13 mm.

Unlike the conventional electromagnet system which has two spaced-apart excitation coils, the electromagnet system of the invention which is integrated in the guide rods, provides an optimal electromagnetic field distribution when the magnet is energized. Since only a single oval-shaped excitation coil is used, the field lines uniformly surround the coil. In the conventional magnet system with two spaced-apart excitation coils, on the other hand, the magnetic fields of the two coils cancel each other in the gap between the two coils, producing at most a small magnetic force in the center between the two coils.

According to an embodiment of the invention, the iron core and the excitation coil wound on the support member have an overall height of less than 10 mm, preferably 7 or 8 mm. The cover surfaces of the pole strips placed on the two front surfaces of the iron core and the excitation coil therefore also have a spacing of less than 10 mm. With this small overall height of the entire electromagnet system, the packing density can be increased by more than 20% over that of conventional guide rods.

According to another embodiment of the invention, the iron core is formed as one piece. Such a one-piece iron core which may have an oval or elongated cuboid form, may be machined from a solid piece. Alternatively, such iron core may be manufactured as one piece by sintering or by a novel MIM (Metal Injection Molding) technology.

Alternatively, the iron core can be formed as several parts. This can be implemented, for example, by arranging side-by-side two or more metal rod elements having a circular cross section. Alternatively, two cuboids whose edges are rounded on one side, may also be arranged side-by-side.

The pole strips arranged on opposing front faces of the iron core or the excitation coil may preferably be formed with a U-shaped cross section. The pole strips may be connected with the iron core by a compression fit, with an adhesive, with riveting and/or by welding. The pole strip is preferably produced by stamping and bending.

In yet another embodiment of the invention, the pole strip is formed as one piece together with the iron core. Such an arrangement can be produced by the afore-described MIM technology.

For example, the pole strip and the iron core may be manufactured as one piece by making one of the pole strips together with the iron core in one piece and then attaching a pole strip to the free front face of the iron core in a conventional manner, for example, by stamping, riveting, gluing or press-fitting. According to another embodiment, a respective section of the iron core may be formed in one piece with a respective one of the two opposing pole strips, whereafter the two iron core sections are merged without producing an air gap.

The thickness of the sheet metal pole strips or pole plates is approximately 1 mm.

The guide rods of the invention will be described in greater detail hereinafter with reference to the drawings.

DETAILED DESCRIPTION OF AN EMBODIMENT

Figure 1:
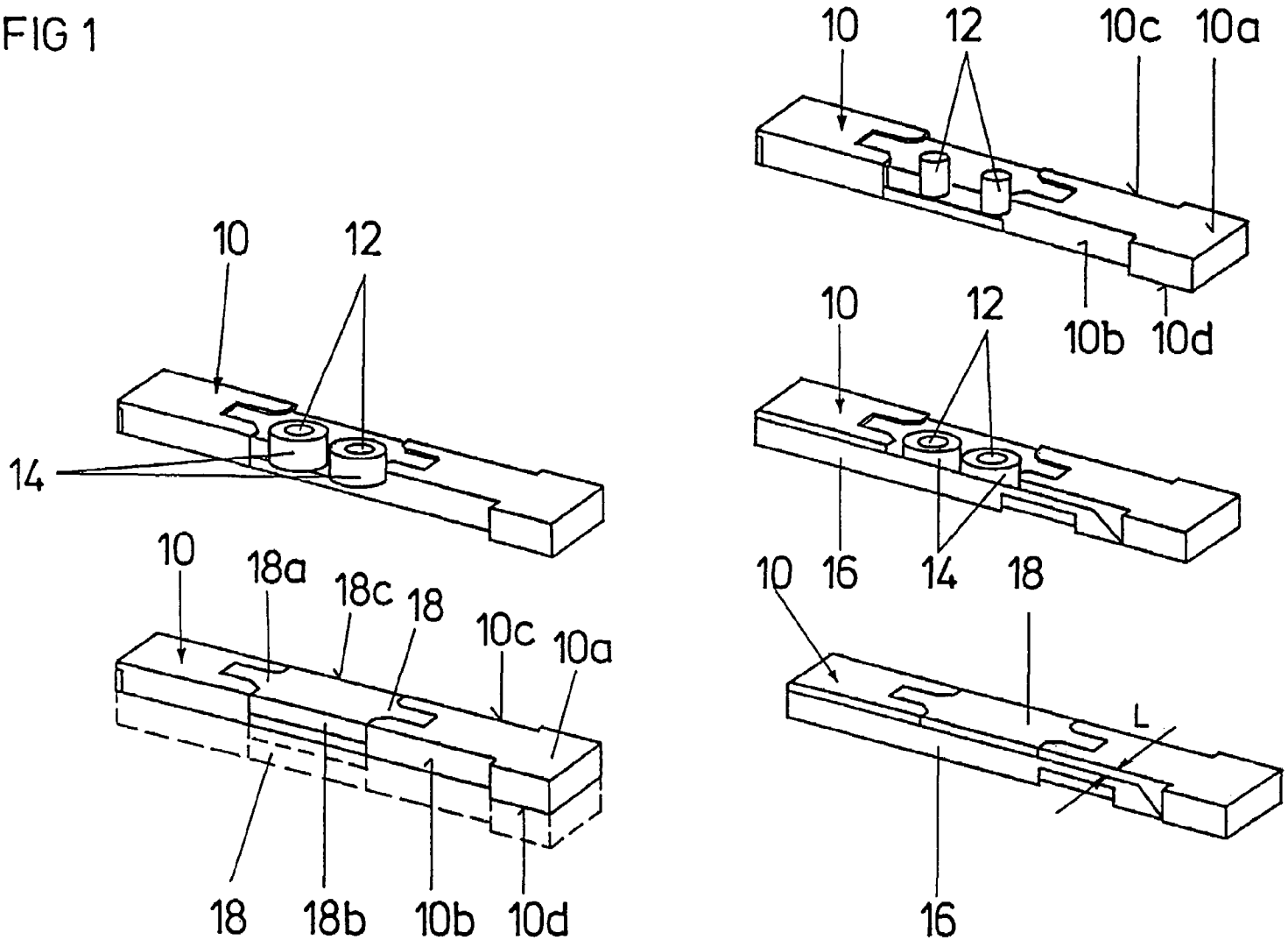
FIGS. 1*a*–1*e* show different perspective views of a section of a conventional guide rod used in Jacquard looms.
Figure 1A:
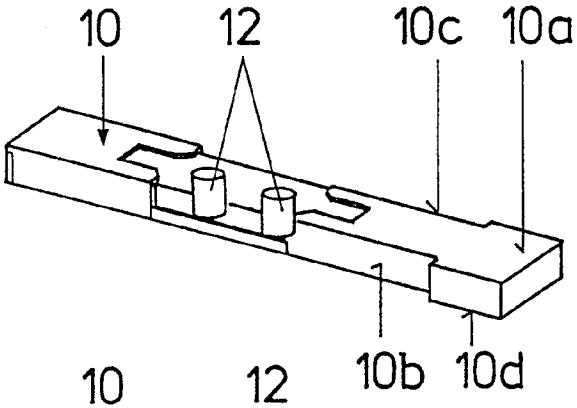

In the following figures, identical parts or parts having an identical function have identical reference numerals, unless otherwise indicated.

Figure 1B:
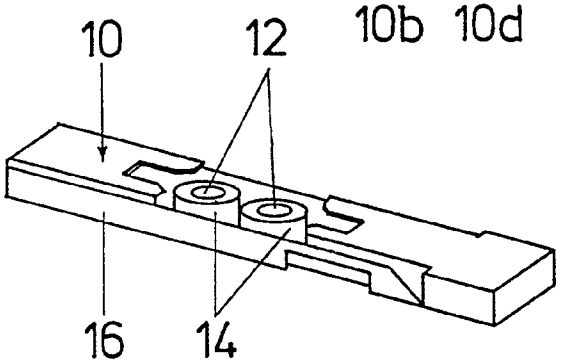
Figure 1C:
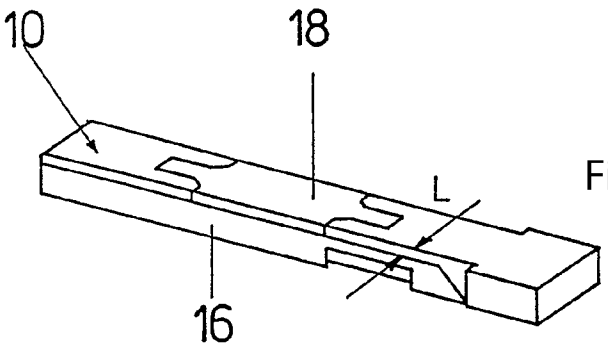
Figure 1D:
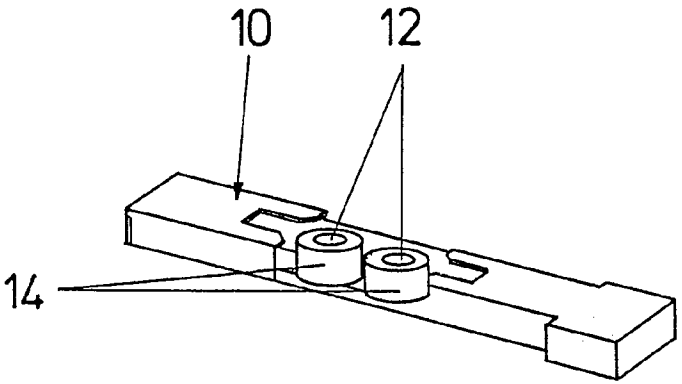
Figure 1E:
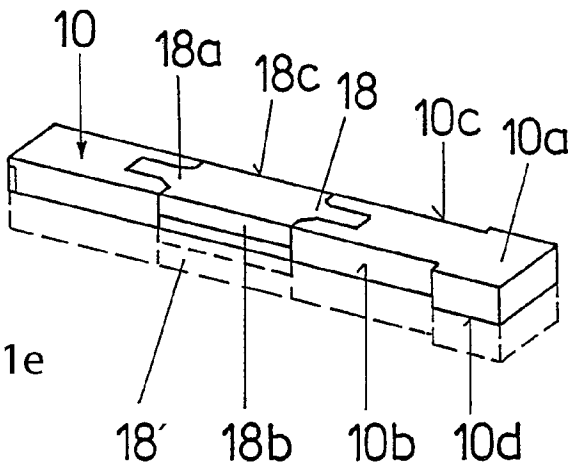

FIGS. 1*a*–1*e* show different perspective views of an upper section of a guide rod 10. An electromagnet system is integrated in the upper section of the guide rod 10. The electromagnet system of the conventional guide rod 10 according to FIG. 1*a* has two support members in the form of iron cores 12 which are spaced apart along the longitudinal axis of the guide rod 10 and have a circular cross section. As seen in FIGS. 1*b* and 1*d*, respective excitation coils 14 are wound around each of the iron cores. The two excitation coils 14 which may each have 1400 turns, are connected in series and connected to a current source through wires (not shown). The iron cores 12 and the excitation coils 14 wound on the iron cores 12 are disposed in a cavity of the guide rod 10, i.e., between the two top surfaces 10*a* and 10*d* and the two opposing side walls 10*b* and 10*c*. As seen in FIGS. 1*c* and 1*e*, a pole strip 18 is placed on each of the front faces of the iron cores 12 and excitation coils 14. This pole strip has a top surface 18*a* which is affixed to the upper front faces of the iron cores 12, for example, with rivets, with an adhesive, by welding or a compression fit. The top surface 18*a* is approximately flush with the top surface 10*a* of the guide rod 10.

Two spaced-apart side walls 18*b*, 18*c* shown in FIG. 1*e* project downwardly in the form of a U from the top surface 18*a* of the pole strip 18. The two side walls 18*b* and 18*c* of the pole strip 18 are flush with the side walls 10*b* and 10*c* of the guide rods.

A second pole strip 18' is arranged on the opposing front faces of the iron cores 12, as indicated by dashed lines in FIG. 1*e*. It should be noted, however, that in FIGS. 1*a*–1*d* the guide rods are illustrated in partial cross sectional view along their symmetry plane. FIG. 1*e* indicates with dashed lines the upper portion of the entire guide rod 10 with the integrated electromagnet system.

The Jacquard lamellae or collar boards 16 contact the two side walls 10*b* and 10*c* of the guide rod 10 in a conventional manner. When the electromagnet system is not energized, i.e., when current does not flow through the excitation coils 14, the Jacquard lamellae 16 are separated from the side walls 18*b* and 18*c* of the pole strips 18 by an air gap L, as indicated in FIG. 1*c*. On the other hand, if current flows through the excitation coils 14, then a magnetic field is produced which pulls the Jacquard lamellae 16 towards the side walls 18*b* and 18*c* of the pole strips.

When the Jacquard lamellae 16 are pulled towards the side walls 10*b*, 10*c* and 18*b* and 18*c*, respectively, the openings in the Jacquard lamellae 16 slide on retention hooks which are not shown in FIGS. 1*a*–1*e*.

The overall height of the conventional guide rods 10 is defined by the dimensions in the axial direction of the iron cores 12 and the excitation coils 14 wound around the iron cores 12, as well as the pole strips 18 applied thereto. Conventional guide rods have an overall height of approximately 13 mm.

Figure 3:
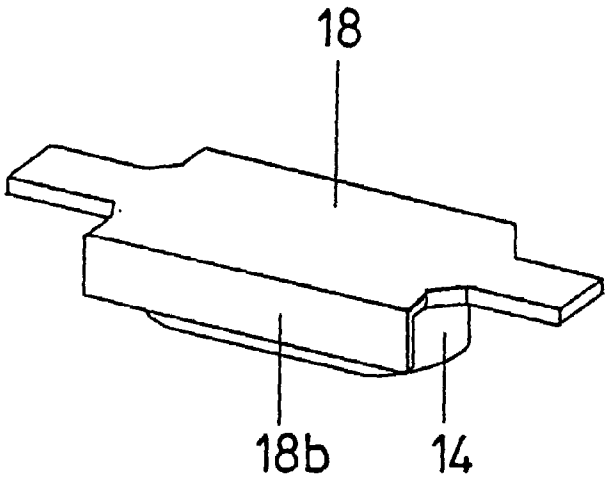
FIG. 3 shows the design illustrated in FIG. 2 with an applied pole strip.
Figure 2:
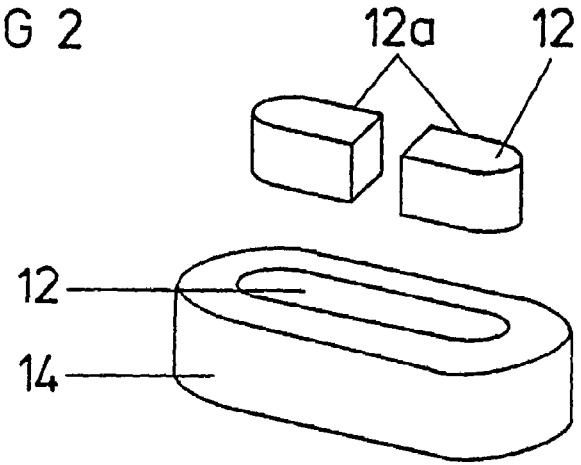
FIG. 2 shows in perspective view an example of an elongated or oval iron core with a wound coil for a magnet system used with a guide rod of the invention.

FIGS. 2 and 3 show a perspective view of the iron core system of the invention, as employed in the guide rods 14. In this case, a single support member, for example in the form of an iron core 22 is provided which may have an elongated or oval cross section. A single excitation coil 24 is wound around the outer surface of the elongated or oval iron core 22 and accordingly has also an oval contour. A pole strip 38, of which only the upper pole strip 38 is shown in FIG. 3, is placed on each of the two front faces of the iron core 22 and the excitation coil 24, respectively.

Although the elongated or oval iron core 22 may be formed as one piece, the iron core 22 of the invention may also be implemented as several pieces, for example, two pieces. This is indicated in the top portion of FIG. 2, which shows two sections 22*a* of iron rods 22 with a circular cross section arranged side-by-side. Instead of arranging the iron core sections 22*a* side-by-side, it is also feasible to package several iron wires in such a way as to produce the elongated or oval cross section of the iron core 22 illustrated in FIG. 2. According to a another embodiment (not shown), two cuboids with a rounded edge can also be placed next to each other.

Figure 5:
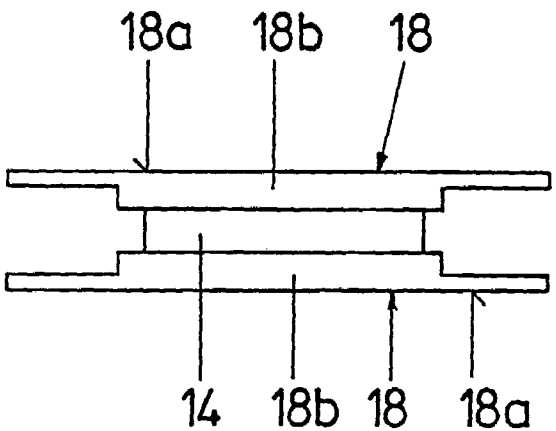
FIG. 5 shows a cross section of a magnet system for a guide rod according to the invention with a significantly reduced overall height as compared to the magnet system of FIG. 4.

FIG. 5 shows a side view of such an electromagnet system. The top surfaces 38*a*, 39*a* of the two pole strips 38, 39 are placed on opposing front faces of the excitation coil 24. The opposing side walls 38*b*, 39*b* of the respective pole strips 38, 39 partially cover the outer surface of the excitation coil 24. The spacing between the top surface 38*a* of the pole strip 38 and the corresponding opposing top surface 39*a* of the pole strip 39 is less than 10 mm, for example, 7 or 8 mm.

Figure 4:
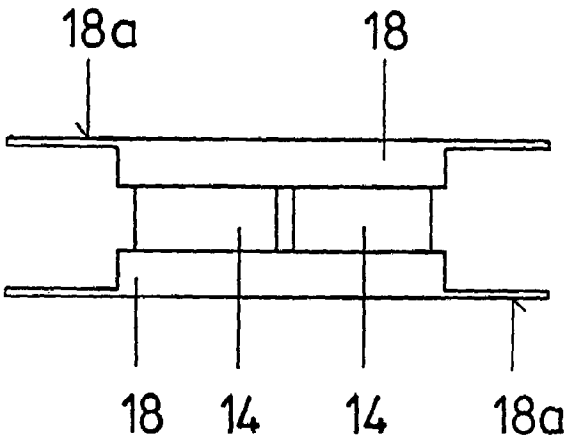
FIG. 4 shows a cross section of a magnet system with two spaced-apart excitation coils and applied pole strips with a conventional magnet system installed in a guide rod.

In comparison, FIG. 4 shows a side view of a conventional magnet system arranged in a guide rod. In this case, the spacing between the top surface 18*a* of the pole strip 18 and the corresponding opposing top surface 19*a* of the pole strip 19 is, for example, 13 mm. The two spaced-apart excitation coils 14 are clearly visible. A comparison of the two FIGS. 4 and 5 clearly shows that while the two electromagnet systems have the same length, the overall height of the system of the invention has been reduced.

Figure 6:
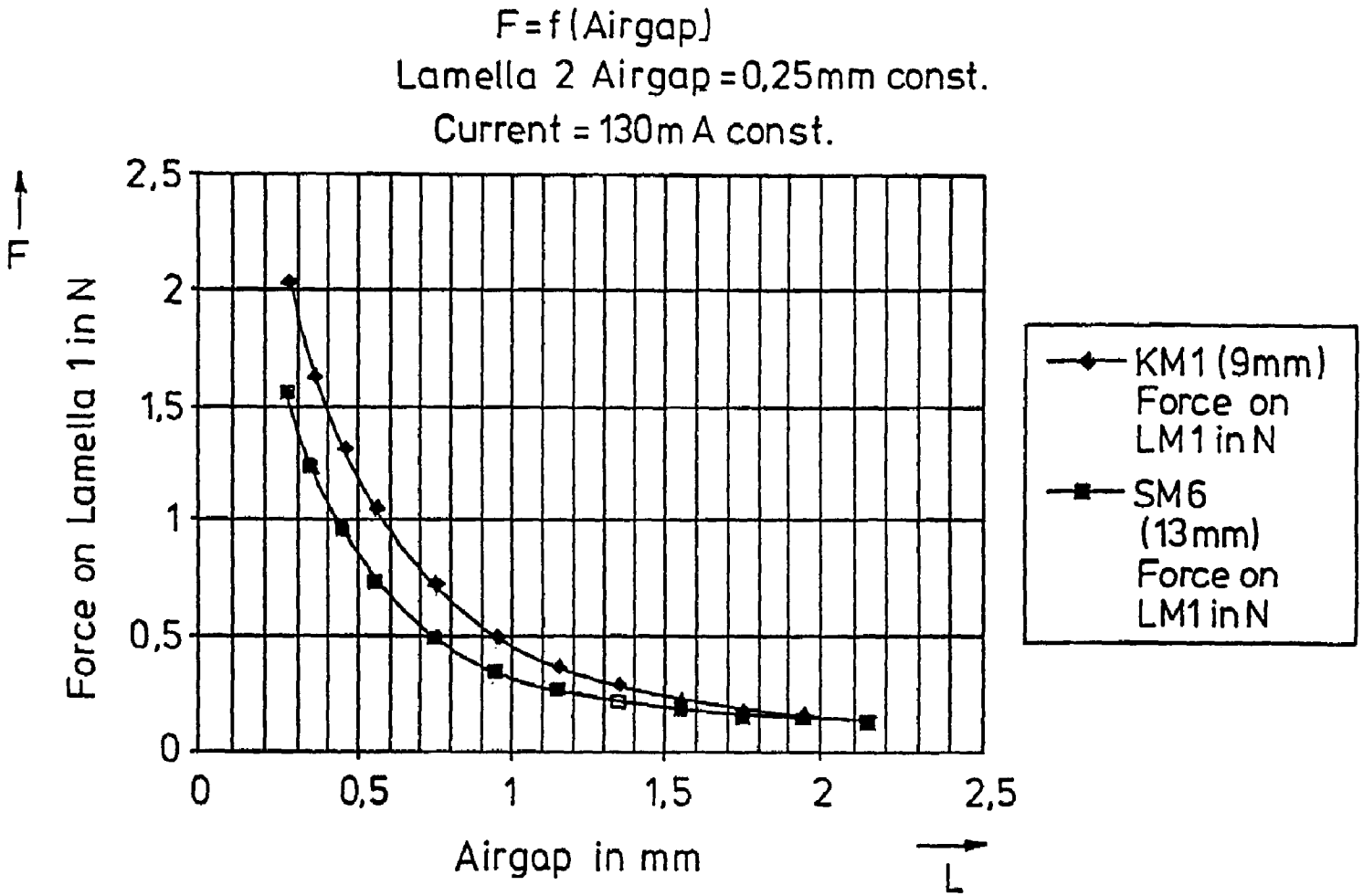
FIG. 6 shows an exemplary force-air gap-characteristics of a conventional magnet system and a magnet system according to the present invention.

FIG. 6 illustrates the force-air gap-characteristics of the electromagnet system with a conventional guide rod 10 (see FIG. 4) and of the magnet system with a guide rod according to the invention (see FIG. 5). The air gap L between the Jacquard lamella 16 and the side wall of the pole strips 18 is taken as 0.25 mm when the excitation coils are not energized. The excitation current is constant at 130 mA. As clearly seen in FIG. 6, the magnetic force generated with the electromagnet system according to the invention with an air gap of 0.25 mm is noticeably greater than the magnetic force generated with the conventional magnet system. With an air gap of 0.25 mm, the magnetic force obtained with the novel magnet system is greater than 2N, whereas the magnetic force with the conventional magnet system under the same operating conditions is only 1.6 N. The illustrated force-air gap curves further demonstrate that the increased magnetic force is maintained until the air gap reaches or exceeds approximately 2 mm.

The increased magnetic force with the same air gap is produced because the magnet system of the invention better optimizes the magnetic field distribution.

What is claimed is:

1. A guide rod for a Jacquard loom having an electromagnet assembly, the electromagnet assembly comprising:

a support member in the form of an iron core having end faces and an oblong circumferential outer surface, an excitation coil having a winding which is wound around the circumferential outer surface of the support member, and two pole pieces, each pole piece having a top surface and arranged to abut an end face of the support member, wherein the respective top surfaces of the pole pieces have a spacing of less than 13 mm therebetween.

2. The guide rod according to claim 1, wherein the spacing of the top surfaces of the pole pieces is less than approximately 10 mm.

3. The guide rod according to claim 1, wherein the support member is formed as one piece.

4. The guide rod according to claim 1, wherein the support member is formed as a multi-element part.

5. The guide rod according to claim 4, wherein the multi-element part comprises a plurality of elements arranged side-by-side, with each element having a round cross section.

6. The guide rod according to claim 1, wherein the pole pieces are U-shaped.

7. The guide rod according to claim 6, wherein the pole pieces are formed by stamping and bending.

8. The guide rod according to claim 1, wherein the pole pieces are attached to the support member of the magnet system by a at least one of press-fitting, gluing, riveting and welding.

9. The guide rod according to claim 1, wherein the pole pieces are connected to the support member so as to form a single piece with the support member.

10. The guide rod according to claim 9, wherein the support member is formed of at least two sections and a pole piece is connected to a respective one of the at least two sections of the support member to form a single piece with the support member.

11. The guide rod according to claim 9, wherein the pole piece and the support member are made as a single piece using MIM (Metal Injection Molding) technology.

12. The guide rod according to claim 1, wherein at least one pole piece has a thickness not exceeding 1.0 mm.

13. The guide rod according to claim 1, wherein the winding is made of copper.

14. The guide rod according to claim 1, wherein the pole piece is made of sheet metal.

15. The guide rod according to claim 4, wherein the multi-element part comprises at least two elements.

16. The guide rod according to claim 1, wherein the spacing of the top surfaces of the pole pieces is approximately 7 or 8 mm.

* * * * *